US008820202B2

(12) United States Patent
Schaub

(10) Patent No.: US 8,820,202 B2
(45) Date of Patent: Sep. 2, 2014

(54) APPARATUS AND METHOD FOR CUTTING A PLURALITY OF FOOD PRODUCTS

(75) Inventor: Joachim Schaub, Hatzfeld-Reddighausen (DE)

(73) Assignee: Weber Maschinenbau GmbH Breidenbach (DE)

( * ) Notice: Subject to any disclaimer, the term of this patent is extended or adjusted under 35 U.S.C. 154(b) by 250 days.

(21) Appl. No.: 13/331,177

(22) Filed: Dec. 20, 2011

(65) Prior Publication Data

US 2012/0167730 A1 Jul. 5, 2012

(30) Foreign Application Priority Data

Dec. 21, 2010 (DE) ..... 10 2010 055 394

(51) Int. Cl.
*B26D 7/06* (2006.01)
*B26D 3/00* (2006.01)

(52) U.S. Cl.
USPC ..... 83/23; 83/42; 83/932

(58) Field of Classification Search
USPC ..... 83/23, 27, 29, 42, 353, 0.354, 356, 83/356.1, 356.2, 356.3, 483, 932, 915.5, 83/76.7, 76.8, 75.5, 72, 58, 63, 367; 99/485; 426/121
See application file for complete search history.

(56) References Cited

U.S. PATENT DOCUMENTS

| | | | | |
|---|---|---|---|---|
| 4,583,435 | A * | 4/1986 | Fessler | 83/90 |
| 5,724,874 | A * | 3/1998 | Lindee et al. | 83/27 |
| 6,152,004 | A * | 11/2000 | Nispel | 83/92 |
| 6,640,681 | B1 * | 11/2003 | Weber | 83/27 |
| 6,935,215 | B2 * | 8/2005 | Lindee et al. | 83/74 |
| 7,073,419 | B2 * | 7/2006 | Weber | 83/14 |
| 7,832,316 | B2 * | 11/2010 | Weber | 83/155 |
| 2003/0145698 | A1 * | 8/2003 | Bucks | 83/13 |
| 2003/0145700 | A1 * | 8/2003 | Lindee | 83/29 |

(Continued)

FOREIGN PATENT DOCUMENTS

| | | | |
|---|---|---|---|
| DE | 19914707 | A1 | 10/2000 |
| DE | 10334643 | A1 | 3/2005 |

(Continued)

OTHER PUBLICATIONS

English Translation of German Search Report Relating to German Patent Application DE 102010055394.8; dated Nov. 30, 2011; 6 pages.
German Search Report Relating to German Patient Application DE 102010055394.8; dated Nov. 30, 2011; 5 pages.

*Primary Examiner* — Sean Michalski
*Assistant Examiner* — Jonathan G Riley
(74) *Attorney, Agent, or Firm* — Cantor Colburn LLP

(57) ABSTRACT

An apparatus for simultaneously slicing a plurality of food products into portions including a plurality of product slices respectively is provided. The apparatus includes a cutting blade which rotates about a blade axis in a cutting plane and/or revolves about a center axis in a planetary motion and includes a multi-track product feed. The feed of the product in one track is respectively interrupted if the residual product remainder in the track is no longer sufficient for forming a complete portion and if the residual product remainder in at least one of the other tracks is still sufficient for forming at least one complete portion. The product remainders are sliced into incomplete part portions once the product remainders of all tracks have reached a dimension which is no longer sufficient for forming a complete portion. The incomplete part portions are completed by product slices of subsequent products.

16 Claims, 15 Drawing Sheets

(56) References Cited

U.S. PATENT DOCUMENTS

| | | | | |
|---|---|---|---|---|
| 2008/0282909 | A1* | 11/2008 | Drebing et al. | 99/537 |
| 2009/0145272 | A1 | 6/2009 | Sandberg et al. | |
| 2010/0307303 | A1* | 12/2010 | Weber | 83/13 |
| 2011/0126680 | A1* | 6/2011 | Weber | 83/13 |

FOREIGN PATENT DOCUMENTS

| | | | |
|---|---|---|---|
| JP | 2001121475 | A | 5/2001 |
| WO | WO 0059689 | A1 * | 10/2000 |
| WO | WO 02/30635 | * | 4/2002 |

* cited by examiner

APPARATUS AND METHOD FOR CUTTING A PLURALITY OF FOOD PRODUCTS

CROSS-REFERENCES TO RELATED APPLICATIONS

This patent application claims the benefit of priority to German Patent Application Serial No. 102010055394.8, filed Dec. 21, 2010 which is incorporated herein by reference in its entirety.

FIELD OF THE INVENTION

The present invention relates to a method for simultaneously slicing a plurality of food products into portions respectively, comprising a plurality of product slices. The products are sliced by a common slicing apparatus, in particular by a high performance slicer, which has at least one cutting blade which rotates about a blade axis in a cutting plane and/or revolves in a planetary motion about a center axis, and to which the products are fed in multiple tracks.

BACKGROUND

Various types of food cutting apparatus are known in the prior art. For example, so-called high-performance slicers are used to slice food products such as sausage, meat or cheese at a high cutting speed. A single cutting apparatus—having a correspondingly large blade—can be utilized by the principle of the multi-track feeding for the simultaneous cutting of a plurality of product loaves or product bars—hereinafter simply: products—in order thus to further increase the cutting performance.

The cut-off product slices are usually combined to portions—for example in stack form or in overlapping form—and are subsequently fed to further processing apparatus such as to a packaging machine. Since the portions have to have a predefined weight and/or a predefined number of slices, it is possible that only an incomplete part portion can be sliced at the end of a product. Since the further processing of incomplete portions should be avoided, but, on the other hand, discarding the product slices is unwanted, in particular with high-quality products, there is a need to complete incomplete part portions. This can generally be done in that incomplete part portions arising at the product end are completed after provision of a new product by product slices of the following product. There is, however, the problem in this respect that, on a product change, first a non-usable end piece of the already sliced product and subsequently a likewise unusable first cut of the new product have to be removed. The incomplete part portion therefore first has to be conveyed away from the effective region of the cutting blade (e.g. on a portioning conveyor) and subsequently be fed back to the effective region. With a multi-track slicing, this requires individually adjustable portioning conveyors for the individual tracks since the products on the individual tracks normally do not come to an end exactly simultaneously. The provision of individually controllable portioning conveyors is, however, complex and expensive since such portioning conveyors usually need to have additional functions. Portion conveyors are designed to be pivotable to the side or downwardly lowerable.

SUMMARY

In one embodiment of the invention, a simple possibility of completing incomplete part portions with a multi-track slicing of food products is provided.

A method for simultaneously slicing a plurality of food products into portions that each include a plurality of product slices is provided. The plurality of food products are sliced by a common slicing apparatus having at least one rotary cutting blade disposed in a cutting plane to which the plurality of food products are fed on a plurality of tracks. The method comprising the step of interrupting a feed of a food product in a track if a residual food product remainder in the track is no longer sufficient for forming a complete portion and if the residual food product remainder in at least one other track is still sufficient for forming at least one complete portion. The method includes the step of slicing the residual food product remainders into incomplete part portions once the residual food product remainders of all tracks have reached a dimension which is no longer sufficient for forming a complete portion. The method includes completing the incomplete part portions by product slices of following food products.

In accordance with an embodiment of the invention, the respective feed of the product in one track is interrupted if the residual product remainder in the track is no longer sufficient for forming a complete portion, and if the residual product remainder in at least one of the other tracks is still sufficient for forming at least one complete portion. The product remainders are sliced into incomplete part portions once the product remainders of all tracks have reached a dimension which is no longer sufficient for forming a complete portion, and the incomplete part portions are completed by product slices of following products.

Slicing is therefore carried out on each track for so long as is possible to produce complete portions. As soon as this is no longer possible on a track, the slicing is interrupted on this track, and is paused until the other tracks can likewise no longer product complete portions. The slicing of the product remainders—producing incomplete part portions—may then take place in a product remainder consumption process common to all tracks. Thus, the incomplete part portions of all tracks can be conveyed away from the effective region of the cutting blade together to create space for the first cut and its respective removal. After the end of the product change phase or first cut phase, the incomplete part portions of all tracks can again be conveyed back together in order thus to be completed by product slices of the following products to be newly sliced. An individually controlled conveying of the incomplete part portions is not necessary. The provision of individually controllable product feeds for the individual tracks is possible with less complexity and/or expense than the provision of individually controllable portioning conveyors.

The part portions may only be moved in and against the conveying direction together, with in particular a conveyor unit being used that is not divided transversely to the conveying direction. This saves the effort of providing a plurality of conveyor units or conveyor sub-units.

In accordance with an embodiment of the invention, the product is moved into a blank cut position retracted with respect to the cutting plane on the interruption of the feed. In this manner, an unwanted scrap formation during the interruption of the product feed can be generally prevented.

The slicing of the product remainders in the individual tracks can be coordinated such that it ends simultaneously in all tracks. In other words, the respective last usable product slice at the product end can be cut simultaneously on all tracks. The rear edges of the incomplete part portions are then aligned in a coinciding manner. The completing can thus start simultaneously on all tracks.

Furthermore, the time sequence of the slicing of the product remainders in the individual tracks can be coordinated with reference to the size of the respective product remainders, with a start in particular being made with the largest residual product remainder on the slicing of the product remainders. The size of the respective product remainders can be detected by suitable sensors. In practice, important key values of the product such as length, thickness, cross-sectional shape or weight can in principle be detected and saved before each slicing procedure. This data may be used to determine the size of the respective product remainders. Since a start is made with the largest residual product remainder on the slicing of the product remainders, a simultaneous ending of the product remainder consumption process can be achieved.

In accordance with a further embodiment of the invention, the completing of the part portions in all tracks is started simultaneously. This facilitates the coordination of the completing process.

In accordance with a further embodiment of the invention, the portions in the tracks are aligned relative to one another with respect to a conveying direction after the completing, in one embodiment such that the front edges of the completed portions are generally at the same level in all tracks with respect to the conveying direction. The alignment can be achieved, for example, by means of track-specific individually controllable belt conveyors—so-called portion stop belts. In this manner, the completed portions can thus be aligned in a manner corresponding to the normally sliced complete portions. This means in particular the offset can be compensated which results by the simultaneously ending slicing of the product remainders in the individual tracks and in the completing of the product remainders in the individual tracks, which thereby ends in an offset manner. Since the alignment after the competing process can take place at any point of the conveying path, it is associated with a relatively smaller effort than if a portioning conveyor having individually controllable tracks were provided.

In accordance with an alternative embodiment of the invention, the slicing of the product remainders is started simultaneously in all tracks. In this embodiment, the front edges of the incomplete part portions are generally aligned in a coinciding manner.

On the completing of the part portions, a start can be made with that part portion which has the highest number of slices required for the completion. The further tracks can then come into play later in the course of the completing process depending on the length of the product remainder.

The completing of the part portions in the individual tracks can in particular be coordinated such that the last slice required for completion is simultaneously added to the part portions of all tracks. In such an aspect, a subsequent alignment of the completed portions relative to one another is not necessary since the rear edges of the completed portions and thus also—with the same number of slices—their front edges are aligned in a coinciding manner from the start.

The completing of the part portions can take place after a common intermediate positioning in a waiting region and a common return into a portioning region, in particular with either the rear edges of all part portions first being returned to a completion position simultaneously, or only the rear edge of a first part portion being returned into a completing position and the rear edges of the other part portions being guided back beyond the completion position. While the part portions are in the waiting region, the transporting away of the product end piece and/or the slicing and removal of the first cut can be carried out without impediment in the portioning region. Provided only the rear edge of a first part portion is returned into a completing position and the rear edges of the other part portions are led back beyond the completing position, care should be taken that the space for leading back is sufficient. That is, no product slices should fall down from the portioning conveyor. Such an aspect is therefore in particular suitable for portions stacked in a flush manner or overlapping to a small degree.

The invention furthermore relates to an apparatus, in particular to a high performance slicer, for the simultaneous slicing of a plurality of food products into portions that each include a plurality of product slices, having a product feed which includes a plurality of conveying devices which are arranged generally parallel next to one another and with which the products can be fed in multiple tracks to a cutting plane in which at least one cutting blade moves (in particular in a rotating and/or revolving manner) with the product feed being configured such that the feed movement can be interrupted and restarted for each track independently of the other tracks, having a transfer unit which is disposed downstream of the cutting blade and is associated with at least some of the tracks and with which complete portions can be transferred to downstream devices and any incomplete part portions present in each case after slicing a product can be completed by product slices of a following product, and having a control device which is designed for the following:

- to interrupt the feeding of the product into a track if the residual product remainder in this track is no longer sufficient for forming a complete portion and the residual product remainder in at least one of the other tracks is still sufficient for forming at least one complete portion; and
- to feed the product remainders to the cutting blade for slicing once the product remainders of all tracks have reached a dimension which is no longer sufficient for forming a complete portion.

Since the feed movement for each track can be interrupted and restarted independently of the other tracks, a complex individually controllable portioning conveyor may not be needed.

The control device may be configured to coordinate the operation of the product feed and the operation of the transfer unit for completing the part portions, in particular such that the slicing of the product remainders ends simultaneously in all tracks and the completing of the part portions is started simultaneously in all tracks, or such that the slicing of the product remainders is started simultaneously in all tracks and a start is made on the completing of the part portions with that part portion which has the highest number of slices required for completing.

The conveying devices can in this respect each have their own drive. Alternatively, the conveying devices can have a common drive, with an adjustable device for the individual adjustment of the conveying speed being provided for each track.

The transfer unit may include at least one conveyor unit not divided transversely to the conveying direction for the exclusive common movement of the part portions in and against a conveying direction. The manufacturing costs of the apparatus can hereby be lowered with respect to an arrangement with individually conveyable part portions.

Furthermore, the transfer unit can include at least two conveyor units following one another in a conveying direction, with the completing of the part portions created at a first conveyor unit being able to take place after an intermediate positioning of the part portions at a second conveyor unit and a return of the part portions to the first conveyor unit.

The conveyor units can each include a belt conveyor, in particular a continuous belt conveyor, which can be operated both in and against the conveying direction.

The transfer unit can furthermore include an alignment conveyor with which portions in the tracks can be aligned relative to one another with respect to a conveying direction after the completing, in one embodiment such that the front edges of the completed portions are at the same level in all tracks with respect to the conveying direction.

BRIEF DESCRIPTION OF THE DRAWINGS

The invention will be explained in the following by way of example with reference to the drawings.

DETAILED DESCRIPTION

Figure 1:
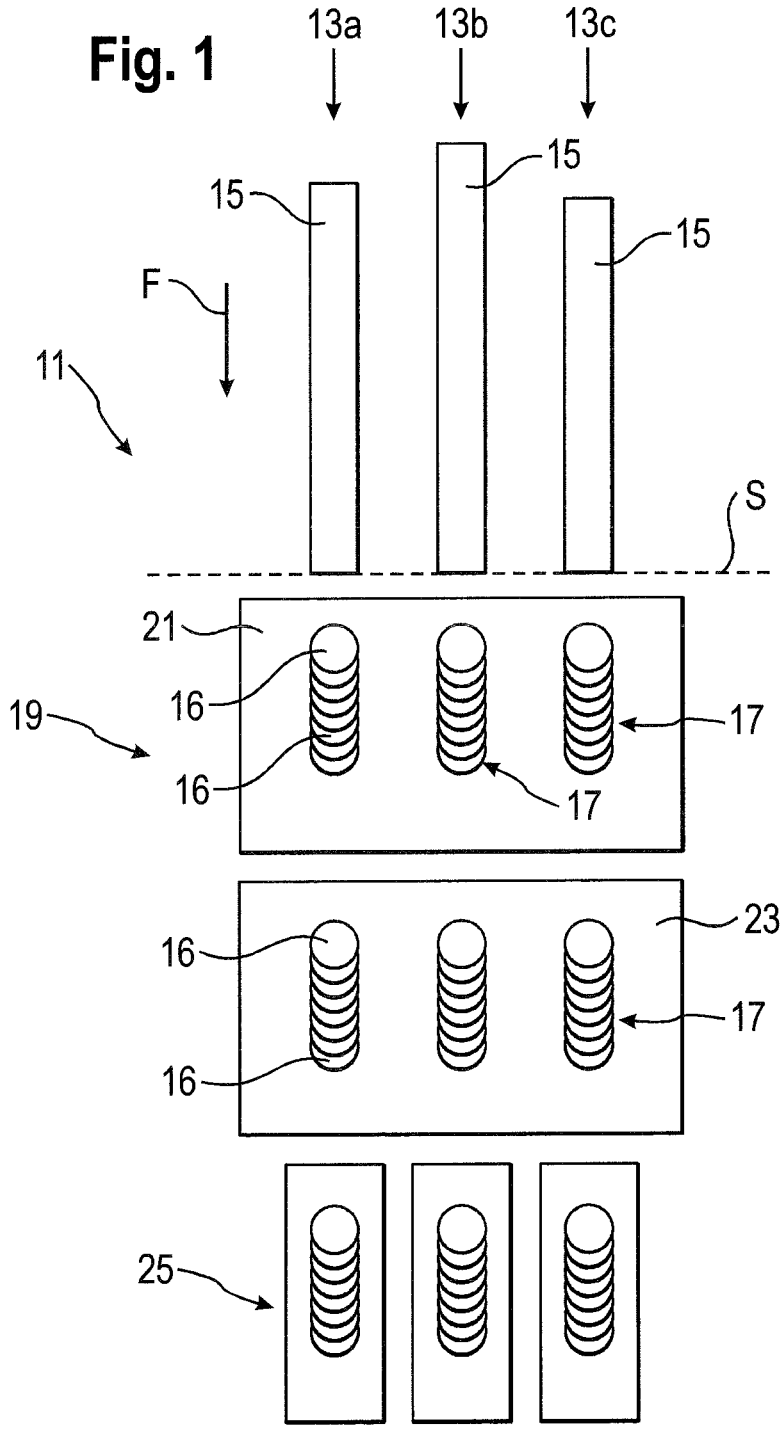
FIGS. 1 to 8 show simplified plan views of an apparatus for slicing food products in accordance with an embodiment of the invention.

In accordance with FIG. 1, a high performance slicer 11 includes a product feed which is not shown in any more detail and which is designed to feed food products 15 in a plurality of parallel tracks 13*a*, 13*b*, 13*c* arranged next to one another along a conveying direction F to a cutting plane S in which a rotating and/or revolving cutting blade (not shown) moves. The product feed includes one or more conveying devices which are configured such that the feed movement along the conveying direction F can be interrupted and restarted for each of the tracks 13*a*, 13*b*, 13*c* independently of the other tracks. Driven gripping claws which engage at the rear product end and/or belt conveyors can be provided as conveying devices in one example. A transfer unit 19 disposed downstream of the cutting blade provides that complete product portions 17, which include eight product slices 16 in the embodiment shown, can be transferred to devices such as a packaging machine disposed downstream, and incomplete parts portions present after slicing a product 15 can respectively be completed by product slices 16 of a following product 15. The transfer unit 19 includes three mutually following conveying devices, namely a portioning conveyor 21 arranged in the direct vicinity of the cutting plane S, a control conveyor 23 arranged downstream of the portioning conveyor 21 and an alignment conveyor 25 arranged downstream of the control conveyor 23. The alignment conveyor 25 may be configured as divided and individually controllable for the individual tracks 13*a*, 13*b*, 13*c*.

In the operating state shown in FIG. 1, the products 15 are continuously supplied to the cutting plane S on all tracks 13*a*, 13*b*, 13*c*, with a control device (not shown) providing that complete portions 17 are prepared on the portioning conveyor 21. The control device is able to control and/or regulate both the conveying devices 21, 23, 25 of the transfer unit 19 and the product feed for the individual tracks 13*a*, 13*b*, 13*c* in accordance with predefined parameters. All products 15 are measured and/or weighed by means of suitable sensors before the start of the slicing operation. The corresponding data is transmitted to the control device and is optionally stored.

Figure 2:
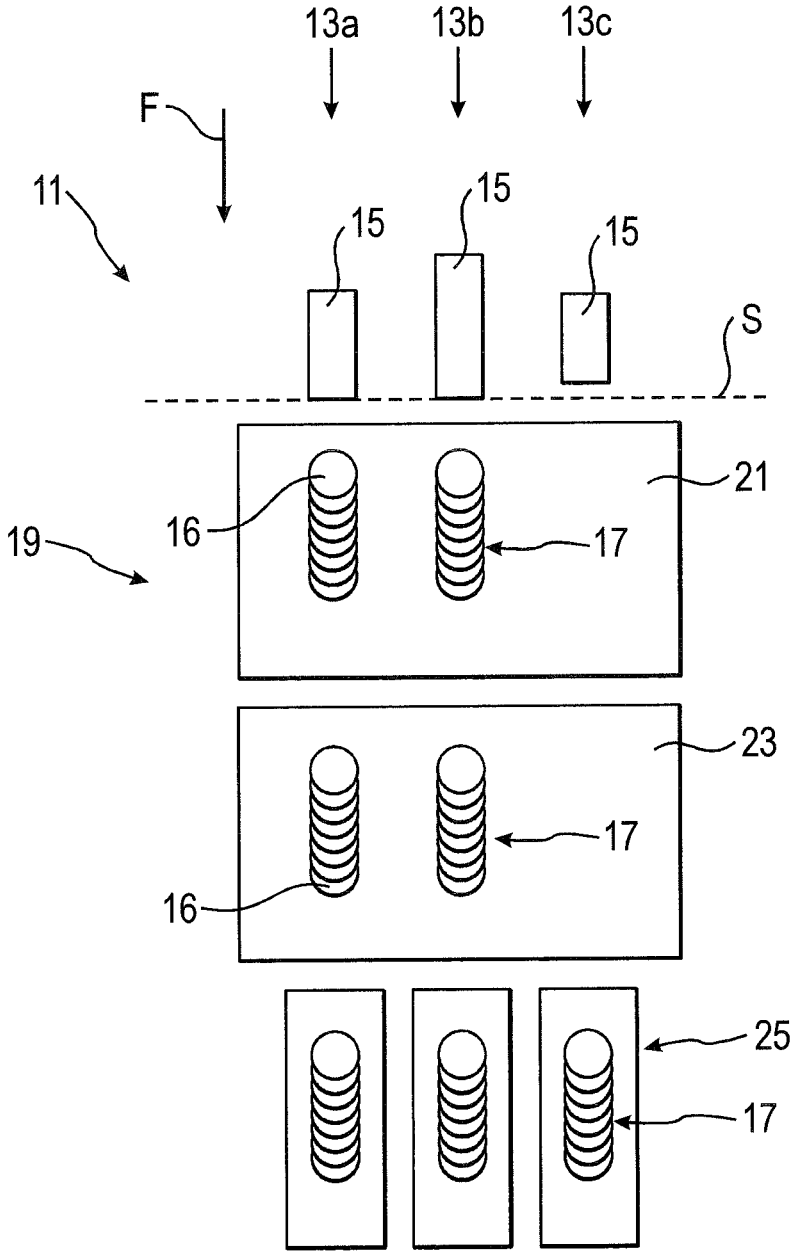

As soon as now the product 15 on the track 13*c* on the right in the Figure comes to an end, for example, and the residual product remainder in this track is no longer sufficient for forming a complete portion 17, but the residual product remainders on the other two tracks 13*a*, 13*b* are still sufficient for forming complete portions 17, the feeding of the product 15 on the product track 13*c* on the right in the Figure is interrupted by a corresponding control of the product feed and the product remainder is moved into a retracted blank cut position (as is shown in FIG. 2). Complete portions 17 are therefore still produced in the usual manner on the two left tracks 13*a*, 13*b*, whereas product slices are no longer cut off on the right track 13*c*. For example, as soon as the product 15 on the middle track 13*b* is sliced so much that the residual product remainder is likewise no longer sufficient for forming a complete portion 17, the slicing is also interrupted on this track 13*b* (i.e. the product feed is stopped and the product 15 is moved into a retracted blank cut position).

Figure 3:
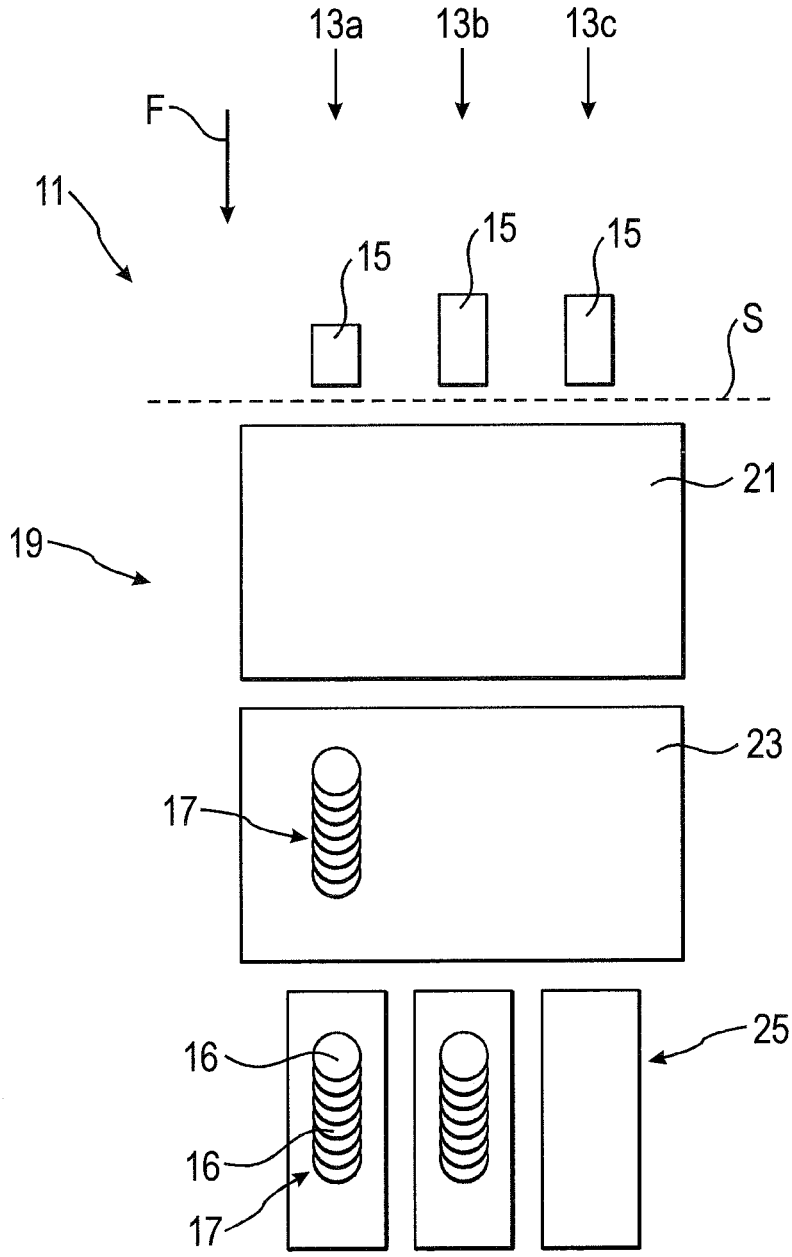

FIG. 3 shows an operating state in which the residual product remainders on all tracks 13*a*, 13*b*, 13*c* are so short that complete portions 17 can no longer be sliced. The products on all product tracks 13*a*, 13*c*, 13*c* are thus located in the blank cut position. It can be seen from FIG. 3 that the last complete portion 17 was sliced on the left product track 13*a*. The complete portions 17 are transferred in the usual manner to subsequent devices.

The product remainders on the tracks 13*a*, 13*b*, 13*c* are of different length. That is, the respective incomplete part portions to be expected are of different size. The size of the product remainder is in this respect independent of the time from which the residual product remainder is no longer sufficient to prepare a complete portion. It is therefore possible due to differences in the product properties (e.g. to a different cross-sectional extent) that the product remainder on the track in which the blank cut operation was first initiated is the longest or also the shortest of all tracks.

Figure 4:
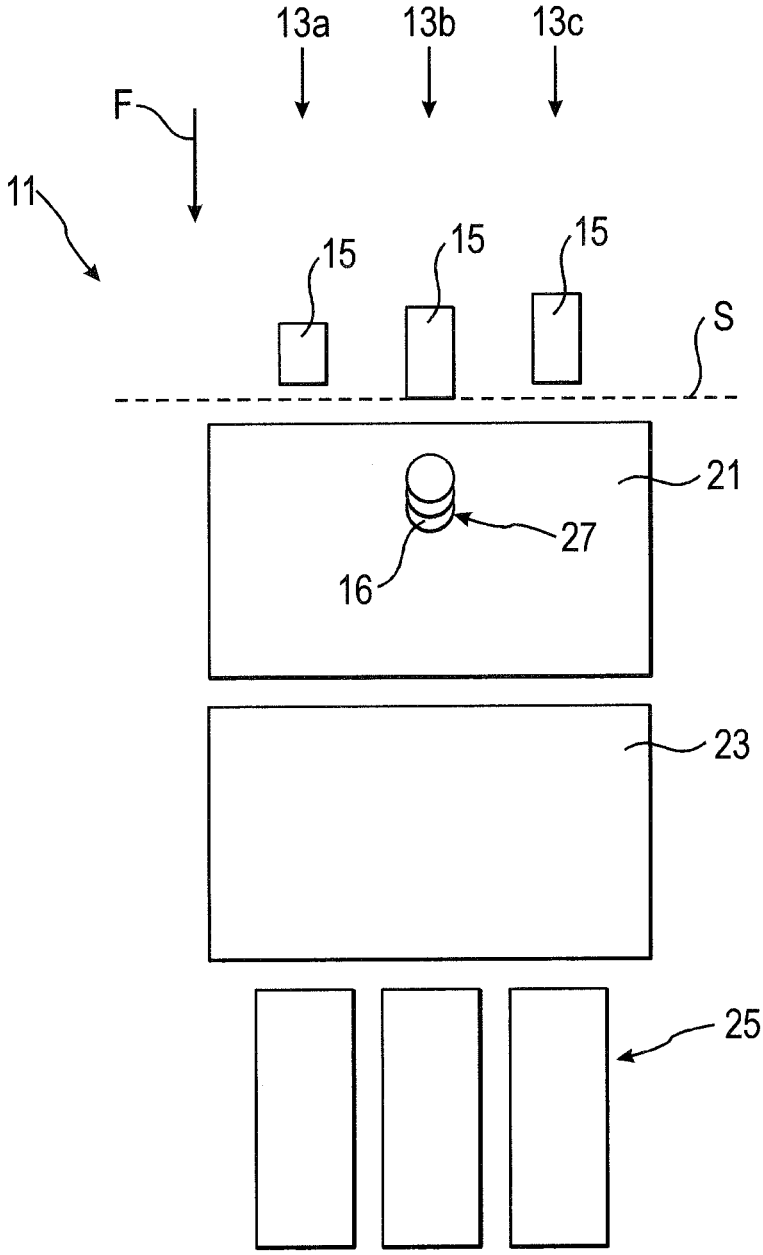
Figure 5:
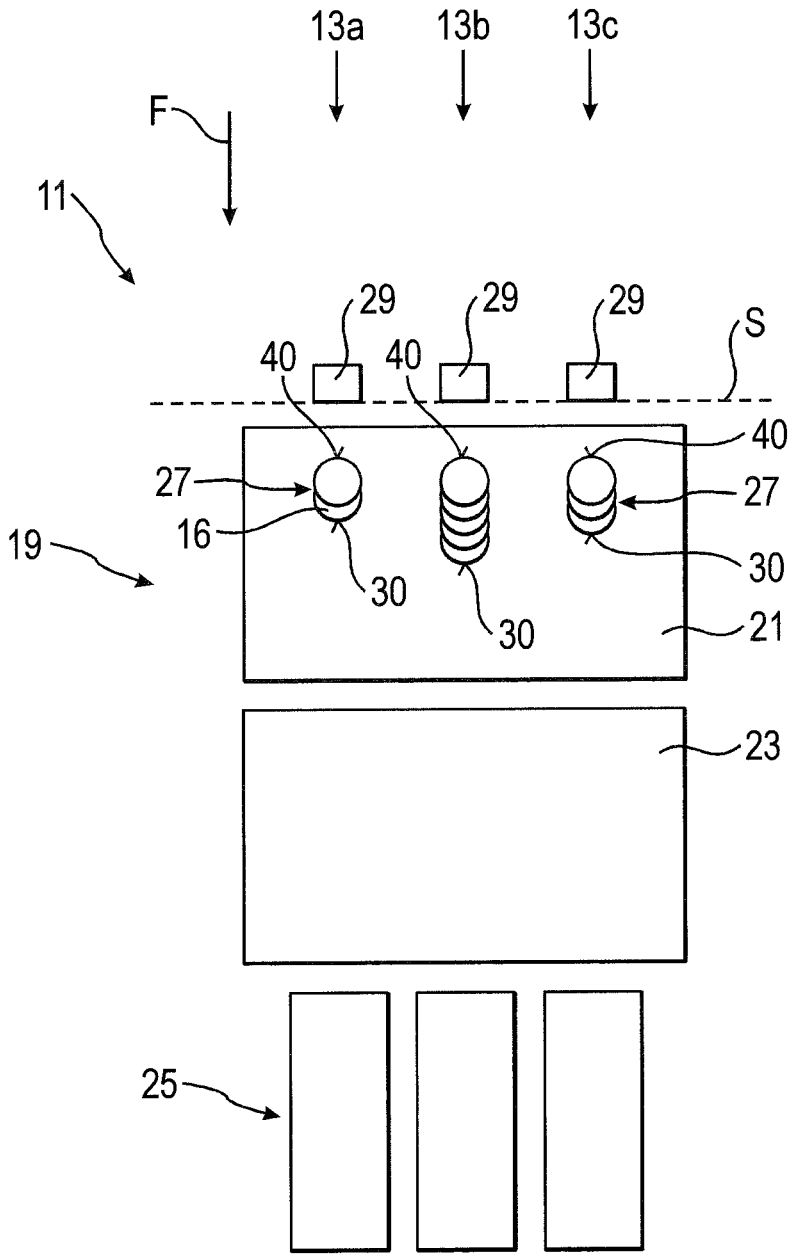

In a common product remainder consumption process, the product remainders are now sliced on all tracks 13*a*, 13*b*, 13*c*, with a start being made with the largest residual product remainder on the middle track 13*b* on the slicing of the product remainders in accordance with FIG. 4. The other tracks 13*a*, 13*c* follow later in accordance with the size of their product remainder, with the control taking place such that the slicing of the product remainders ends simultaneously in all tracks 13*a*, 13*b*, 13*c*. The last usable product slice 16 is therefore cut simultaneously on all tracks 13*a*, 13*b*, 13*c* so that the rear edges 40 of the incomplete part portions 27 are aligned flush (i.e. are at the same level with respect to the conveying direction F). This state is shown in FIG. 5.

Figure 6:
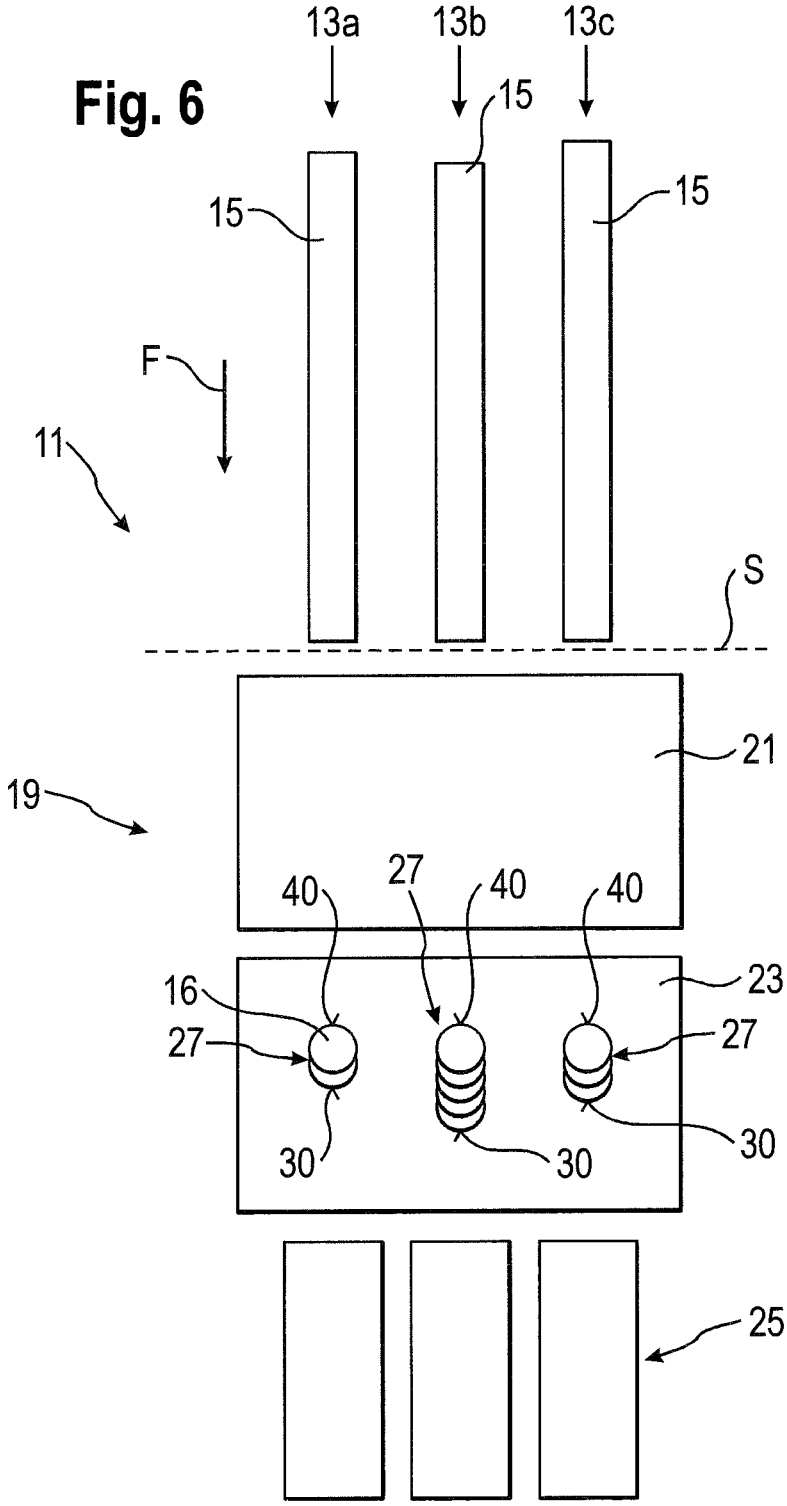

The residual end pieces 29, which can no longer be used, are retracted and removed from the cutting plane S, for example by a cap provided in the product feed. Furthermore, the incomplete part portions 27 are conveyed together by the portioning conveyor 21 in the conveying direction F on the control conveyor 23 as is shown in FIG. 6. New products 15 are now placed on all tracks 13*a*, 13*b*, 13*c*, with the non-usable first cut being sliced and removed from the portioning conveyor 21 in each case which is operated against the conveying direction F for this purpose. The new products 15 may subsequently again be moved into the blank cut position shown in FIG. 6.

Figure 7:
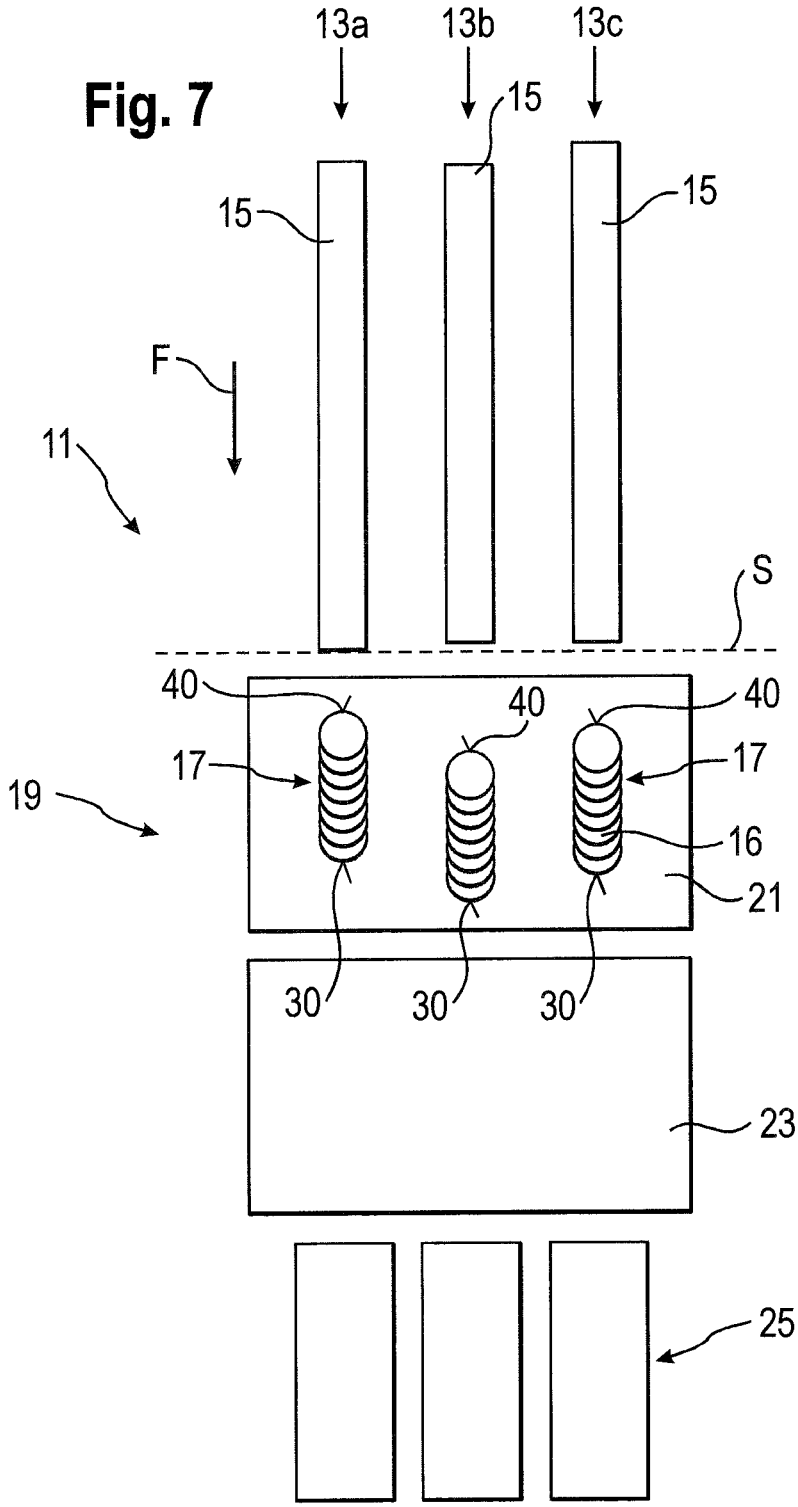

Subsequently, in accordance with FIG. 7, the incomplete part portions 27 are conveyed against the conveying direction F by the control conveyor 23 back to the portioning conveyor 21 and are positioned such that the overlapping part portions 27 are correctly further overlapped by recently cut off product slices 16. Now the completing of the part portions 27 is started on all tracks 13*a*, 13*b*, 13*c*, (i.e. the products 15 are simultaneously fed from the blank cut position to the cutting plane S). As soon as the first part portion 27 has been completed, the product 15 on the corresponding track, in this case on the middle track 13*b*, is again moved into the blank cut position. In the operating state shown in FIG. 7, the two right tracks 13*b*, 13*c* are already in the blank cut position, whereas just the last slice 16 was cut off for completing the part portion on the left track 13*a*. The completed portions 17, which are arranged offset with respect to one another due to the different start of the product remainder consumption process along the conveying direction F both at the front edge 30 and at the rear edge 40, are moved on to the control conveyor 23 by the portioning conveyor 21 and are moved away from the former onto the divided alignment conveyor 25.

Figure 8:
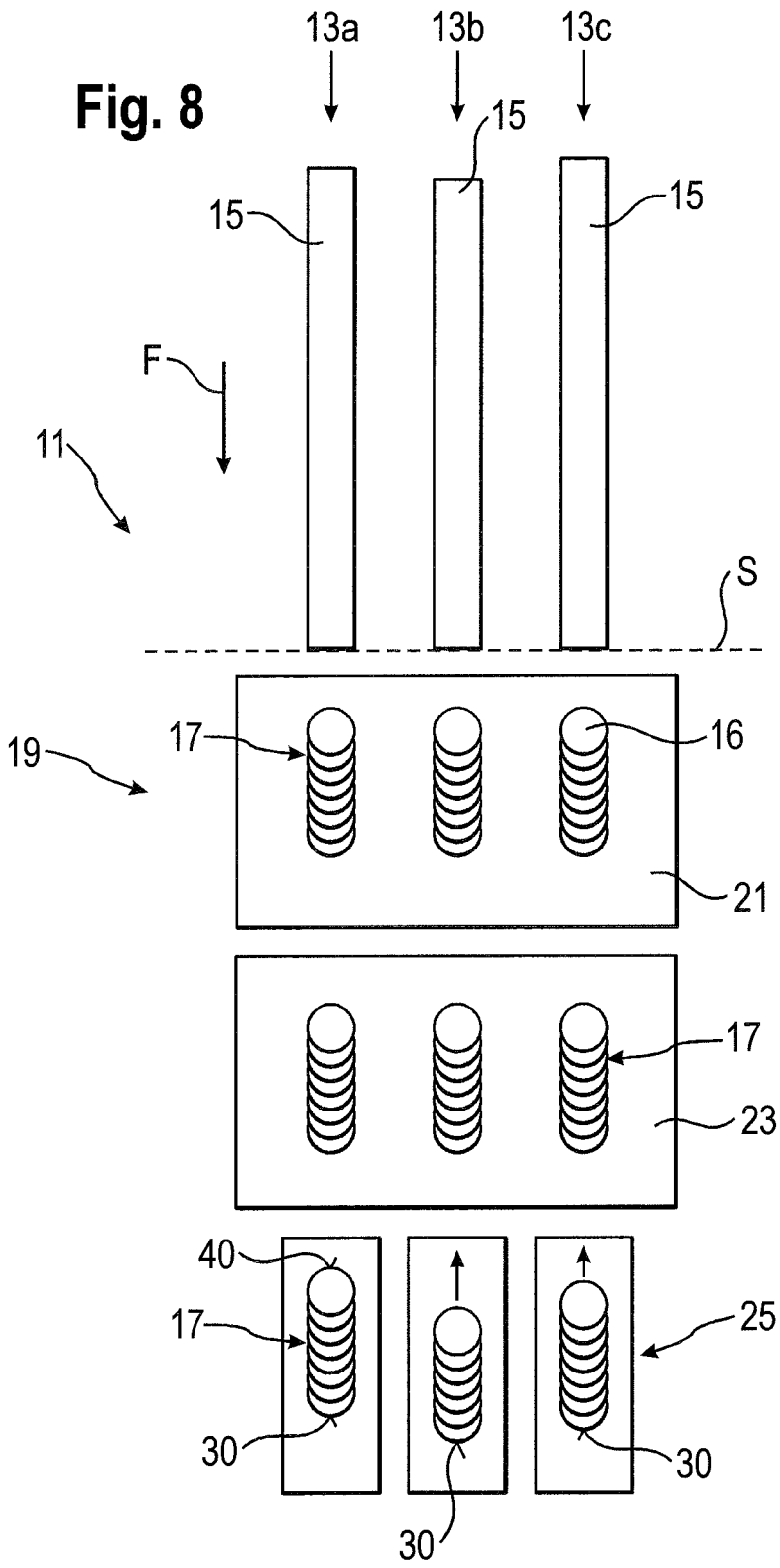

As is shown by arrows in FIG. 8, the front edges 30 of the completed portions 17 are aligned on the divided alignment conveyor 25—for example by means of individually controllable portion stop belts—such that the front edges 30 of the completed portions 17 are generally at the same level in all tracks 13*a*, 13*b*, 13*c* with respect to the conveying direction F. All present part portions are now completed to complete portions 17 and are generally aligned correctly to one another. In addition, the permanent operation in accordance with FIG. 1 can be started again on the tracks 13*a*, 13*b*, 13*c* in which complete portions 17 are sliced in a normal manner.

Figure 9:
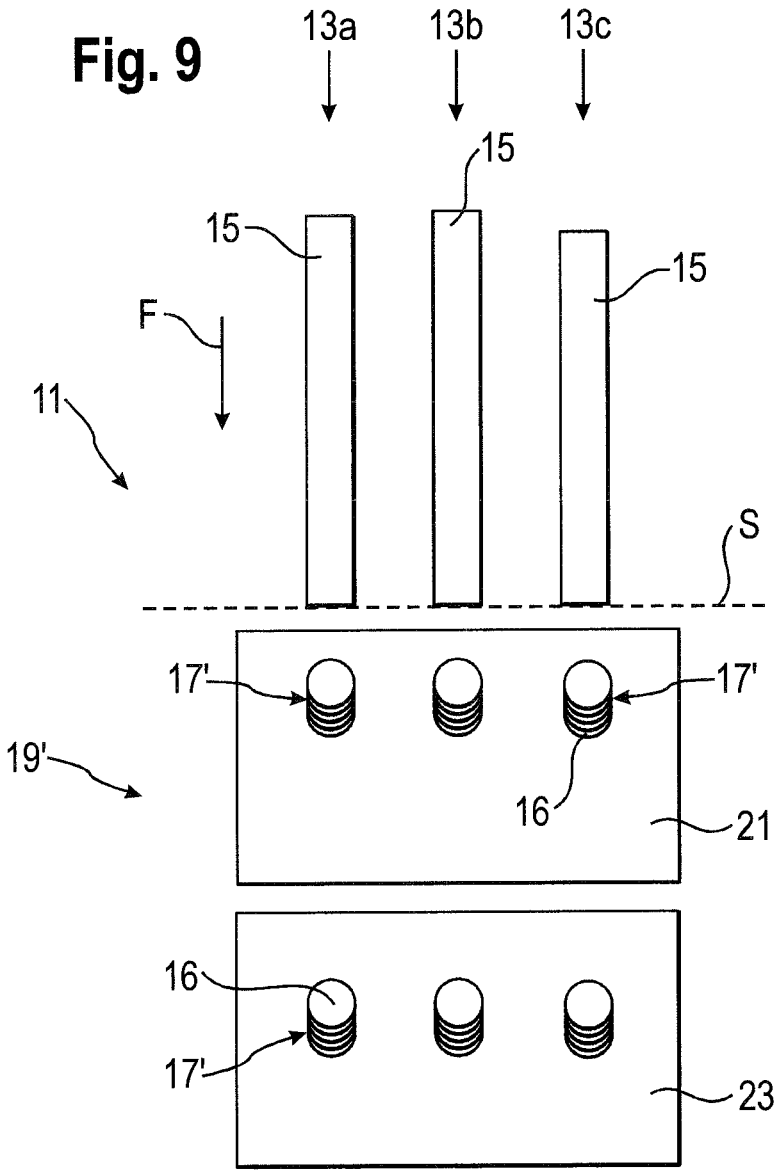
FIGS. 9 to 15 show simplified plan views of an apparatus for slicing food products in accordance with another embodiment of the invention.

An alternative method for slicing food products in a plurality of tracks will be described with reference to FIGS. 9 to 15. The high performance slicer 11 shown in FIGS. 9 to 15 is of a similar structure as in the embodiment illustrated in FIGS. 1 to 8, with here, however, the divided alignment conveyors 25 being able to be omitted. Portions 17' are prepared which are only overlapped with a relatively slight offset. FIG. 9 in turn shows a permanent operation state in which complete product portions 17' are prepared continuously following one another and are transferred by a transfer unit 19' to a downstream processing device.

Figure 10:
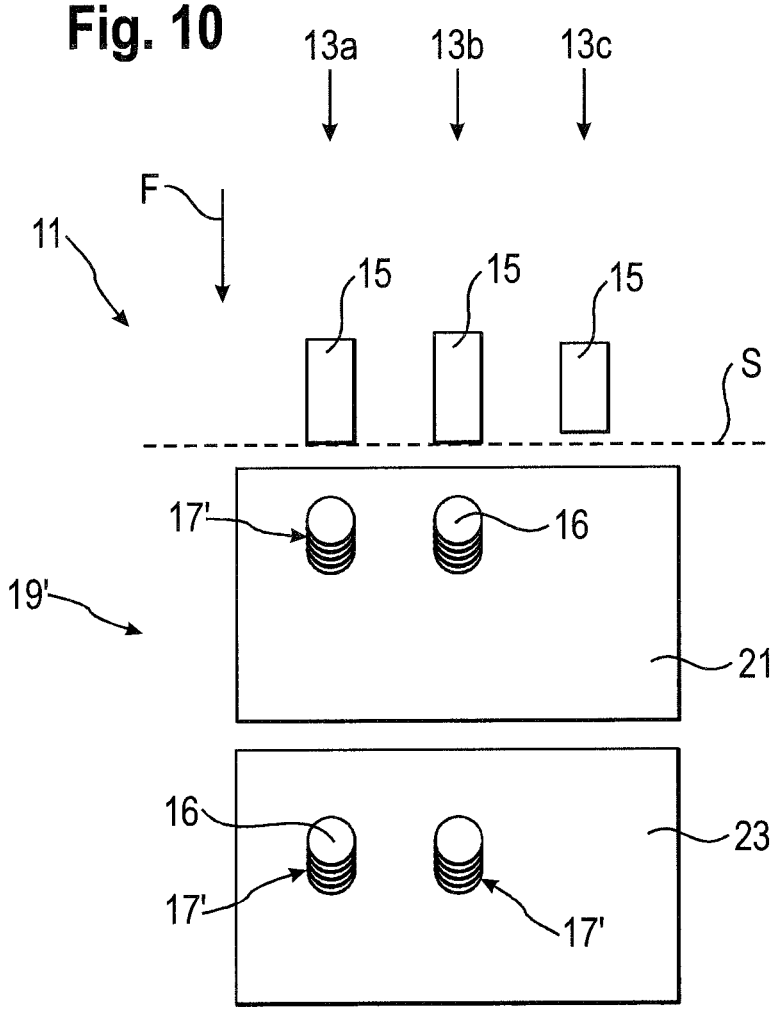

As in the embodiment shown in FIGS. 1 to 8, the feed of the product 17' is interrupted in the right track 13*c*, for example, if the residual product remainder in this track is no longer sufficient for forming a complete portion 17' and the residual product remainder in the two other tracks 13*a*, 13*b* is still sufficient for forming at least one complete portion 17'. On the two left product tracks 13*a*, 13*b*, complete portions 17' are then still sliced, whereas the product 15 on the right product track 13*c* is moved into the blank cut position. This state is shown in FIG. 10.

Figure 11:
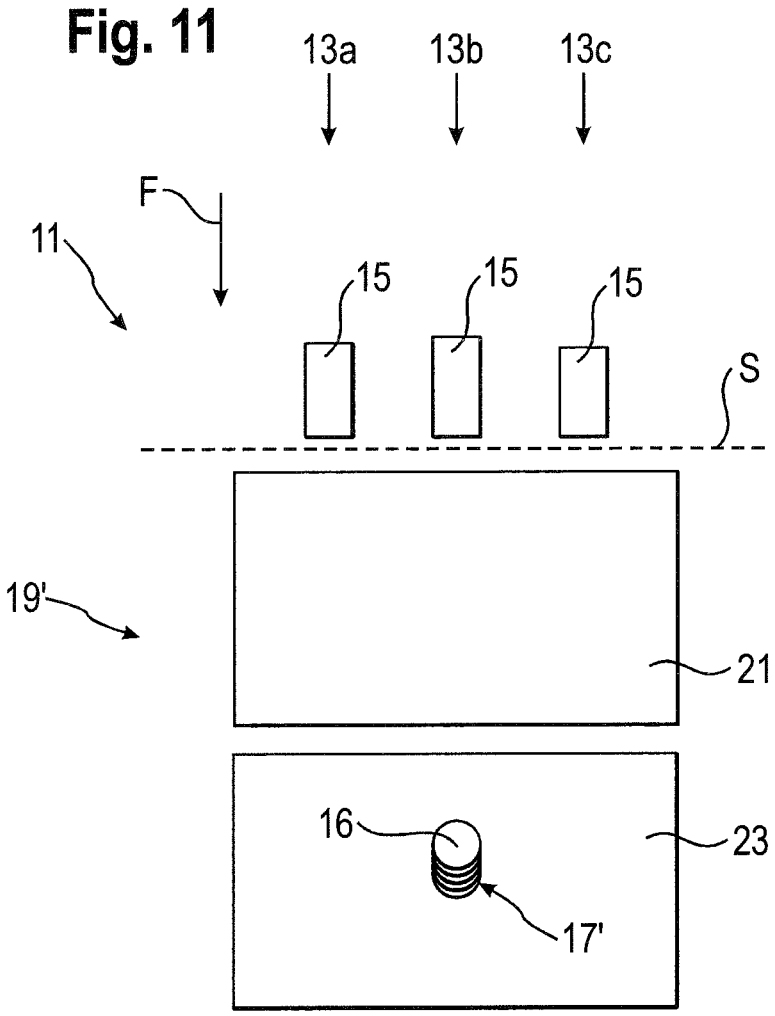

As soon as the product remainder is not sufficient for forming a complete portion 17' on the left product track 13*a*, for example, the product 15 on the product track 13*a* is also moved into the blank cut position. FIG. 11 shows an operating state in which the residual product remainders on all tracks 13*a*, 13*b*, 13*c* are no longer sufficient for forming a complete portion 17' and in which accordingly the products 15 on all tracks 13*a*, 13*b*, 13*c* have been transferred into the blank cut position. As can be seen from FIG. 11, the product 15 of the middle product track 13*b* was transferred last into the blank cut position.

Figure 12:
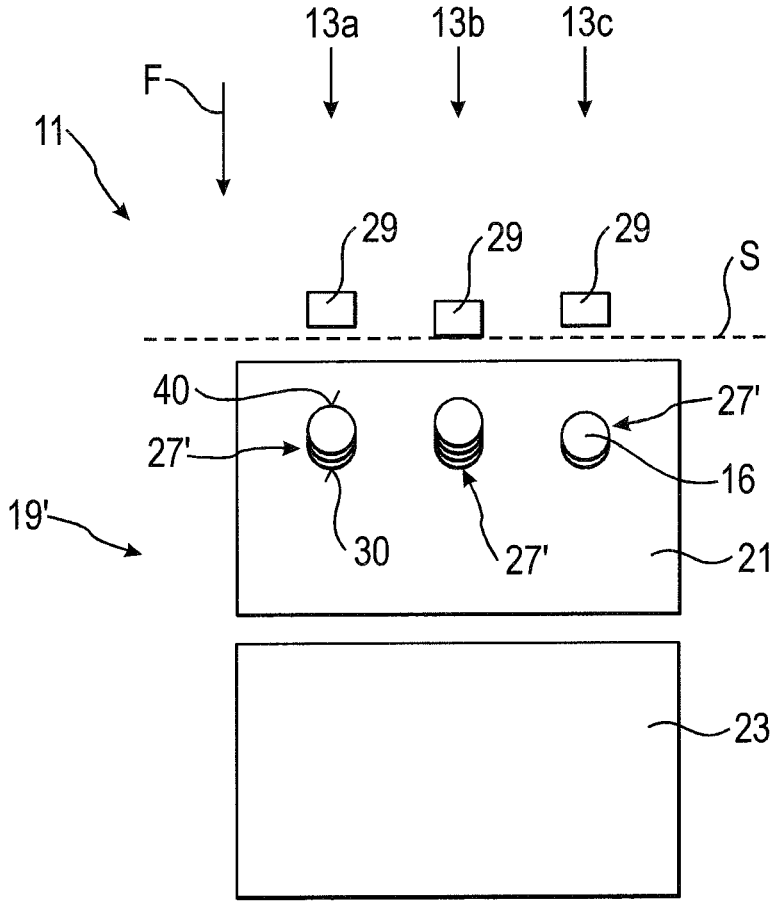
Figure 13:
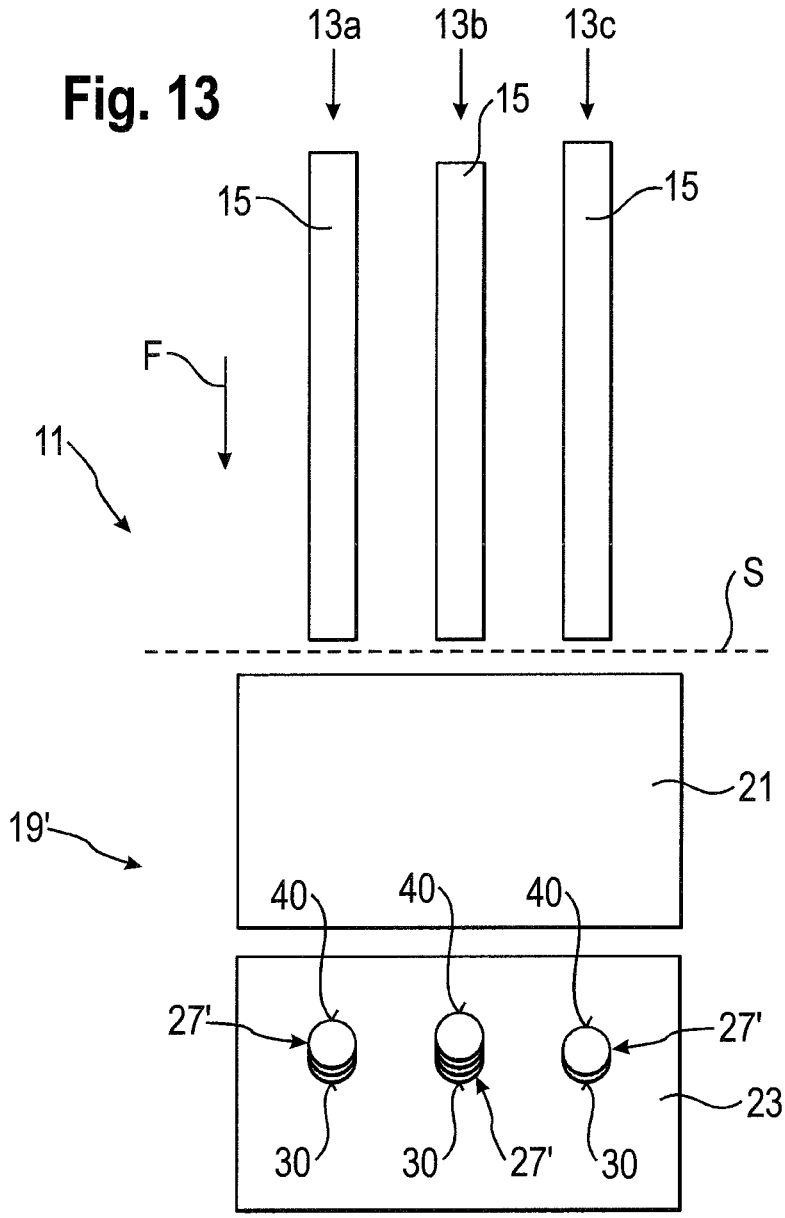
Figure 14:
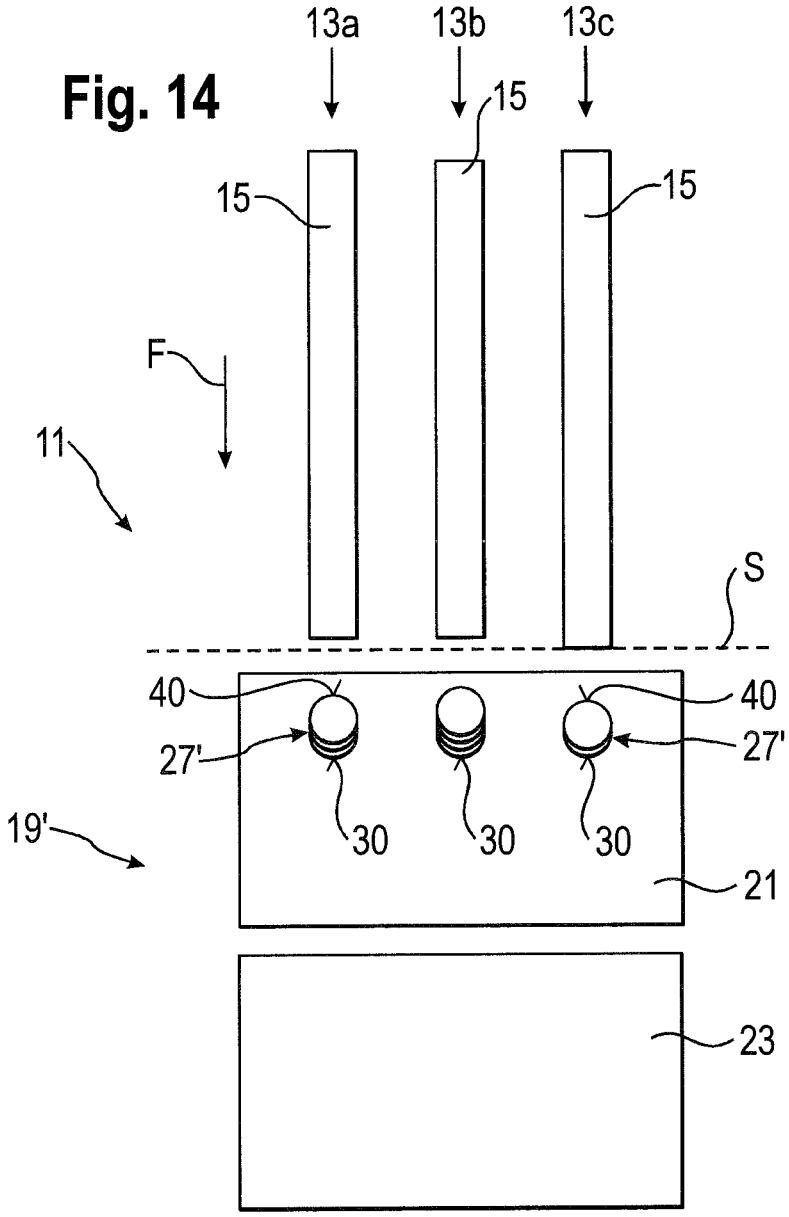
Figure 15:
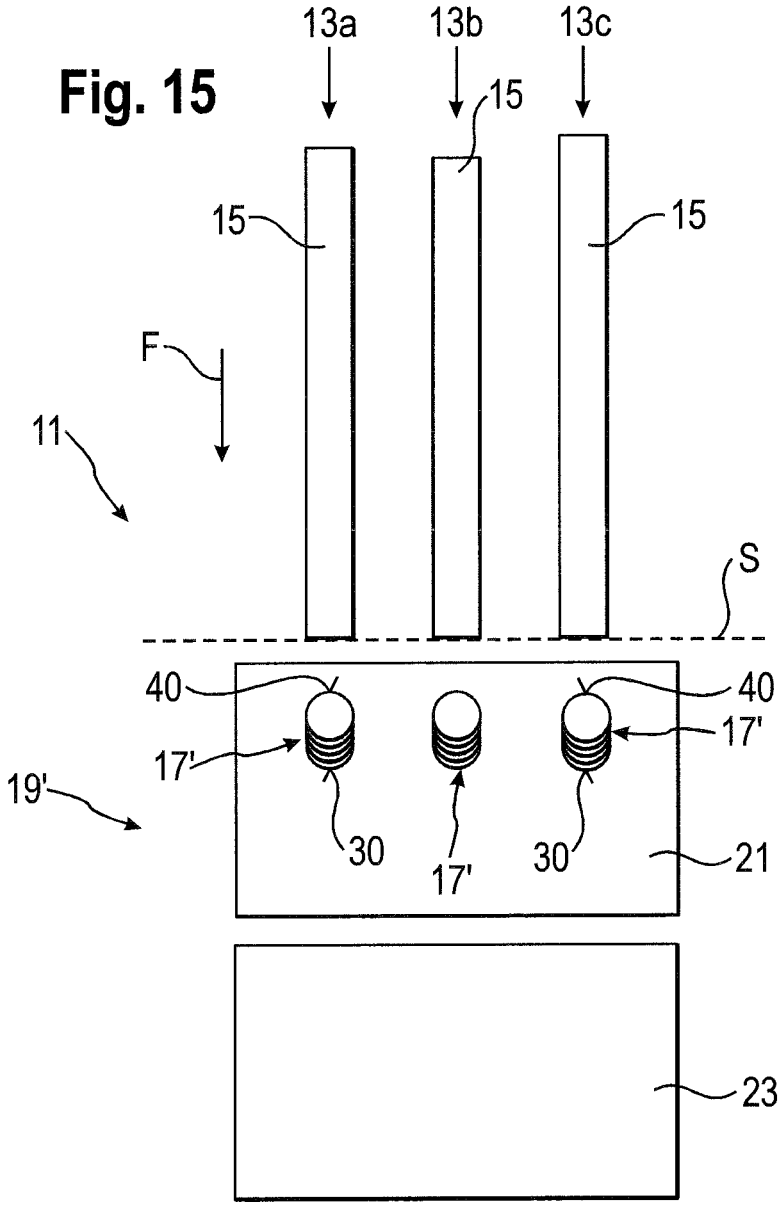

In accordance with FIG. 12, the incomplete part portions 27' are now sliced, with the slicing of the residual product remainders being started simultaneously in all tracks 13*a*, 13*b*, 13*c*. Accordingly, therefore the front edges 30 of the part portions 27' on all tracks 13*a*, 13*b*, 13*c* are aligned in a coinciding manner (i.e. they are at the same level with respect to the conveying direction F). As soon as all product remainders except for the non-usable end pieces 29 have been sliced, the part portions 27' formed up to then are conveyed by the portioning conveyor 21 onto the control conveyor 23. The end pieces 29 are then removed, as described above. Furthermore, new products 15 are placed into the high performance slicer 11 and a first cut is made. As soon as the non-usable first cut has been removed from the portioning conveyor 21 (FIG. 13), the part portions 27' are again conveyed back against the conveying direction F by the control conveyor 23 onto the portioning conveyor 21. In this respect, the rear edge 40 of the part portion 27' of the right track 13*c* is returned into a completing position, whereas the rear edges 40 of the other—longer—part portions 27' are consequently led back beyond the completing position. Subsequently, the part portions 27' are completed, and indeed starting with the part portion 27' on the right track 13*c* which has the highest number of product slices 16 required for completing. This operating state is shown in FIG. 14.

The other product tracks 13*a*, 13*b* become involved in the completing in a "flying manner" depending on when the rear edge 40 of the respective part portion 27' reaches the completing position. After completion of this process, both the front edges 30 and the rear edges 40 of the completed portions 17' are aligned in a coinciding manner. The completed portions 17' can now be transferred in a usual manner and the forming of new complete portions 17' can restart in the permanent operating state shown in FIG. 9.

This alternative may also be suitable for portions from slices stacked in a coinciding manner. The extent to which this alternative is generally suitable for overlapping portions depends on the dimension by which the specific apparatus respectively allows portions to be led back with their rear edges beyond the completing position without slices falling down.

The invention claimed is:

1. A method for simultaneously slicing a plurality of food products into portions each including a plurality of product slices, the plurality of food products being sliced by a common slicing apparatus having at least one rotary cutting blade disposed in a cutting plane to which the plurality of food products are fed on a plurality of tracks, the method comprising the steps of:

interrupting a feed of a food product in a track of one of the plurality of tracks if a residual food product remainder in the track is no longer sufficient for forming at least one complete portion and if the residual food product remainder in at least one other track is still sufficient for forming at least one complete portion;

slicing the residual food product remainders into incomplete part portions once the residual food product remainders of all of the plurality of tracks have reached a dimension which is no longer sufficient for forming the at least one complete portion; and completing the incomplete part portions by a product slice of following food products.

2. The method in accordance with claim 1, including at least one of the steps of rotating the rotary cutting blade about a blade axis, and revolving the rotary cutting blade about a center axis in a planetary motion.

3. The method in accordance with claim 1, comprising the step of moving the incomplete part portions only together in and against a conveying direction.

4. The method in accordance with claim 3, and comprising the step of using a conveyor unit not divided transversely to the conveying direction.

5. The method in accordance with claim 3, comprising the step of moving the food product into a blank cut position retracted with respect to the cutting plane on interruption of the feed.

6. The method in accordance with claim 1, the method comprising the step of coordinating slicing of the residual food product remainders in the plurality of tracks such that slicing ends simultaneously in all of the plurality of tracks.

7. The method in accordance with claim 1, comprising the step of coordinating a time sequence of slicing of the residual food product remainders in individual ones of the plurality of tracks with reference to a size of the respective residual food product remainders.

8. The method in accordance with claim 7, comprising the step of starting coordination with a largest residual food product remainder on slicing of the residual food product remainders.

9. The method in accordance with claim 1, the method including the step of starting completing of the incomplete part portions in all of the plurality of tracks simultaneously.

10. The method in accordance with claim 1, the method comprising the step of aligning the at least one complete portions in the plurality of tracks relative to one another with respect to a conveying direction after the completing step.

11. The method in accordance with claim 10, wherein aligning is carried out such that front edges of the at least one complete portions in all of the plurality of tracks are generally at the same level with respect to the conveying direction.

12. The method in accordance with claim 1, comprising the step of slicing of the residual food product remainders simultaneously in all of the plurality of tracks.

13. The method in accordance with claim 1, further comprising the step of coordinating the completing of the incomplete part portions in the plurality of tracks such that a last product slice required for completion is added simultaneously to the incomplete part portions of all of the plurality of tracks.

14. The method in accordance with claim 1, comprising the step of making a start, on the completing of a part portions, with one of the part portion having a highest number of product slices required for completion.

15. The method in accordance with claim 1, in which the step of completing of the incomplete part portions takes place after a common intermediate positioning in a waiting region and a common return into a portioning region.

16. The method in accordance with claim 15, including one of the steps of first returning rear edges of all of the incomplete part portions into a completion position simultaneously and returning only a rear edge of a first part portion into a completing position, with the rear edges of other part portions being guided back beyond the completion position.

* * * * *